United States Patent [19]

Scolaro et al.

[11] 3,963,206

[45] June 15, 1976

[54] BABY BOTTLE HANDLE

[76] Inventors: Barbara Scolaro; George Spector, both of 3615 Woolworth Bldg., 233 Broadway, New York, N.Y. 10007

[22] Filed: May 20, 1975

[21] Appl. No.: 579,136

[52] U.S. Cl. ..... 248/105; 248/145.6; 294/31.2; 215/100 A

[51] Int. Cl.[2] ..... A61J 9/06

[58] Field of Search ..... 215/100 A; 248/102, 248/103, 104, 105, 107, 145.6; 294/27 R, 27 H, 31.2, 33

[56] References Cited

UNITED STATES PATENTS

| | | | |
|---|---|---|---|
| 2,855,120 | 10/1958 | Bramming | 215/100 A X |
| 3,016,221 | 1/1962 | Underwood | 248/102 |
| 3,101,857 | 8/1963 | Freedman | 215/100 A |
| 3,421,789 | 1/1969 | Klomparens | 294/31.2 |
| D198,704 | 7/1964 | Meagher | 215/100 A X |

*Primary Examiner*—Donald F. Norton

[57] ABSTRACT

An holder for supporting a warmed baby bottle while an infant feeds therefrom, the holder consisting of a single part having a ring at one end through which the bottle is inserted, and the other end of the device forming a long handle that is parallel and spaced from a side of the bottle so that it can be conveniently held in a person's hand.

4 Claims, 6 Drawing Figures

10
16
12
15
11

14
11
10
13
15
12

11
14
10
12

23
24
20
22
12
14
21
13
11

22
12
24
25
24
26

13
22
21
11
24
12
14
26
25

BABY BOTTLE HANDLE

A principal object of the present invention is to provide a holder for retaining a baby bottle while an infant feeds therefrom, the holder having a handle so that it can be more conveniently grasped by a person instead of directly grasping the bottle.

Another object is to provide a baby bottle handle which, in a modified design of the invention, includes a grasping handle portion which is adjustable so to form a tripod so to support the bottle in an operative position for feeding the infant thus eliminating need of a person holding it.

Other objects are to provide a baby bottle handle which is simple in design, inexpensive to manufacture, rugged in construction, easy to use, and efficient in operation.

These and other objects will be readily evident upon a study of the following specification, and the accompanying drawing wherein.

Figure 1:
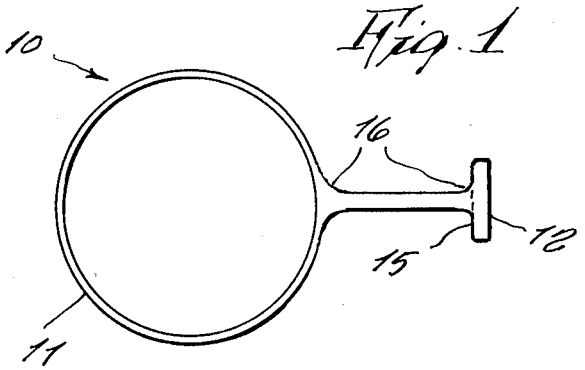
FIG. 1 is an end view of the invention.
Figure 3:
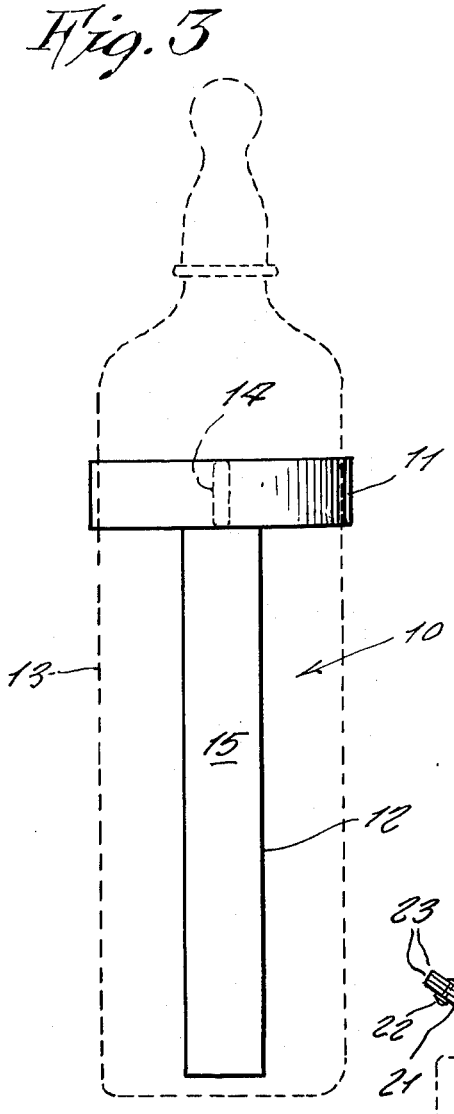
FIG. 3 is a side elevation view thereof.
Figure 2:
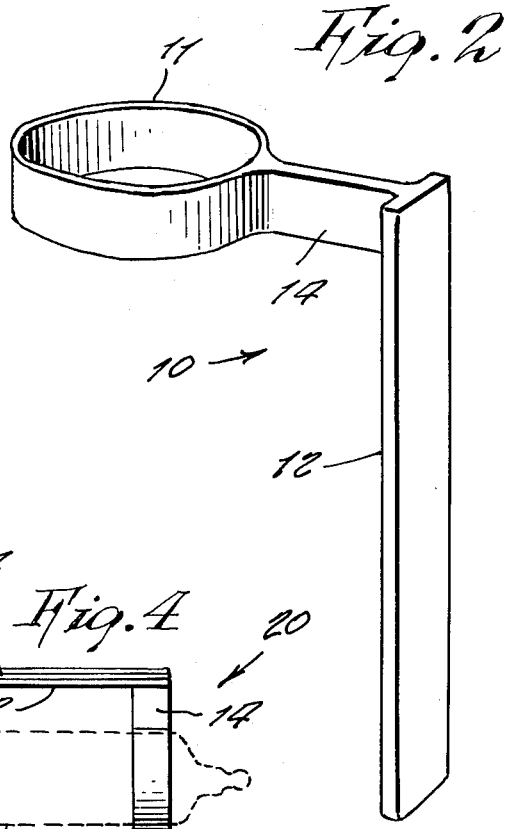
FIG. 2 is a perspective view thereof.

Referring now to the drawing in detail, and more particularly to FIGS. 1 to 3 thereof at this time, the reference numeral 10 represents a baby bottle handle device according to the present invention wherein there is a one piece article which at one end has a circular ring 11 and which at its other end has a straight grasping handle element 12.

The device is preferably made of a molded hard plastic, so to be inexpensive, precise in size so to frictionally fit a baby bottle 13 through the ring, having no crevices so that it can be easily kept clean and sanitary, and which may be made in any attractive color.

It is to be noted that the longitudinal axis of the handle element is parallel to a central axis of the ring.

The ring is cylindrical in shape by being 7/16 of an inch wide while being only 1/16 of an inch thick. A thin fin 14, about 1⅛ inch long extends between an outer peripheral side of the ring and one end of the handle element 12. The handle element is made flat by being ⅛ inch thick, ½ inch wide and 4 inches long. The fin 14 is connected to one of the flat sides. 15 of the handle element thus produced, and the opposite ends of the fin has rounded, larged radial fillets 16 so to eliminate any dirt catching sharp inner corners.

In operative use, as shown in FIG. 3, the baby bottle 13 is simply inserted into the ring, and the device is ready for use.

Figure 4:
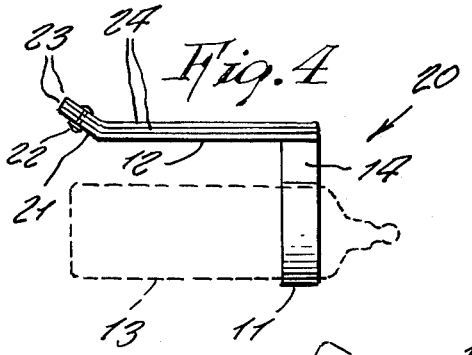
FIG. 4 is a side view of a modified design of the invention wherein the same includes a handle having two legs attached pivotally thereto and which in a stored away position rest adjacent the handle.
Figure 5:
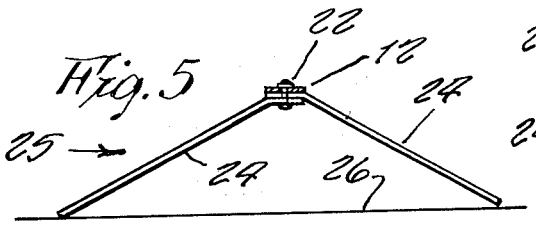
FIG. 5 is an end view thereof with the legs pivoted sidewardly so that as shown in FIG. 6, the device forms a stand which supports a baby bottle in an inclined position so an infant can thus nurse itself without need of an adult holding the bottle for the infant.
Figure 6:
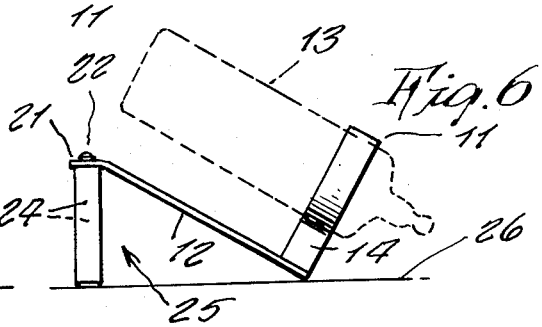

In FIGS. 4 through 6, a modified design of a baby bottle handle 20, made likewise of hard plastic includes all the above described elements except that the handle element may be made slightly still thinner, and its terminal end 21 is bent outward at an angle. A single rivet 22 through the terminal end 21 extends also through correspondingly bent terminal ends 23 of two legs 24 who have a major portion thereof straight so that they are positioned adjacent the outer side of the handle element 12 as shown in FIG. 4. The legs are of a same size and shape as the handle element so that when thus positioned adjacent the handle element they can all be grasped together in a person's hand and used similarly as above described.

The legs, however, are pivotable about the rivet so that they can be swinged apart as shown in FIGS. 5 and 6 so that together with the handle element they form a tripod 25 for supporting the baby bottle at a correct angle so an infant can feed itself without need of a person holding the device in his hand. The tripod can stand up on any supporting surface 26 such as a pillow, folded blanket, or directly upon the crib sheet.

Thus a modified design is provided. While various changes may be made in the detail construction, it is understood that such changes will be within the spirit and scope of the present invention, as is defined by the appended claims.

What is claimed is:

1. In a baby bottle handle device, the combination of a cylindrical ring and a straight handle, said ring being circular and adapted to receive and retain frictionally therethrough a baby bottle, including a transverse spacer fin integrally connecting the ring and one end of said handle wherein said handle is parallel to the ring axis.

2. A device as in claim 3 including means mounted on said handle adapted to coact with said handle to support the ring at a predetermined inclination relative to a supporting surface.

3. A device as in claim 2 wherein said means is adjustable and is movable from a collapsed position in abutting parallel alignment with said handle to a second position providing supports spaced from said handle and ring.

4. A device as in claim 1 including an opposite end of said handle having an angularly bent terminal portion and a rivet therethrough, further including a pair of similar legs and same shape and size of said handle positioned adjacent an outer side of said handle, wherein said rivet extends through the said terminal portion of said handle and legs, wherein said legs are pivotable to a position extending angularly away from said handle and said ring to form a support for said ring.

* * * * *